US006457586B2

(12) United States Patent
Yasuda et al.

(10) Patent No.: US 6,457,586 B2
(45) Date of Patent: Oct. 1, 2002

(54) BANK-NOTE PROCESSING DEVICE

(75) Inventors: Shigeru Yasuda, Tsurugashima (JP); Yukio Ito, Saitama (JP); Tadashi Hatamachi, Sakado (JP); Noboru Yamagishi, Tsurugashima (JP); Kouji Akiba, Tsurugashima (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 0 days.

(21) Appl. No.: 09/788,190

(22) Filed: Feb. 16, 2001

(30) Foreign Application Priority Data

Feb. 25, 2000 (JP) ..... 2000-049678
May 30, 2000 (JP) ..... 2000-160563

(51) Int. Cl.[7] ..... B07C 5/344
(52) U.S. Cl. ..... 209/534; 194/206
(58) Field of Search ..... 209/534, 567, 209/588, 900; 271/177–181; 194/206, 207

(56) References Cited

U.S. PATENT DOCUMENTS 4,628,194 A * 12/1986 Dobbins et al. ..... 235/379
4,478,274 A 11/1988 Mori et al.
4,784,274 A * 11/1988 Mori et al. ..... 209/534
4,880,096 A 11/1989 Kobayashi et al.
5,167,411 A 12/1992 Isobe
5,333,714 A * 8/1994 Watabe et al. ..... 194/206
5,411,249 A * 5/1995 Zouzoulas ..... 271/181
5,547,062 A 8/1996 Mays et al.
5,657,846 A 8/1997 Schwartz
5,964,336 A * 10/1999 Itako et al. ..... 194/207
6,142,284 A 11/2000 Saltsov
6,158,565 A * 12/2000 Mikami et al. ..... 194/206

FOREIGN PATENT DOCUMENTS

JP 08-007148 * 1/1996

* cited by examiner

*Primary Examiner*—Donald P. Walsh
*Assistant Examiner*—Joseph Rodriguez
(74) *Attorney, Agent, or Firm*—Welsh & Katz, Ltd.

(57) ABSTRACT

A unit box (11) containing a bank-note conveyor belt unit (4) and a bank-note identifying unit (5) and not containing a bank-note accommodating unit, is provided in an openable and closable fashion with respect to a body (3) of a bank-note processing device (1), so that a conveyor belt (21) facing the side of a bank-note input opening (2) is exposed when the unit box (11) is opened.

20 Claims, 12 Drawing Sheets

BANK-NOTE PROCESSING DEVICE

BACKGROUND OF THE INVENTION

1. Field of the Invention

The present invention relates to a bank-note processing device for determining the authenticity of bank notes introduced thereinto and accumulating and holding genuine notes in a stacker.

2. Description of the Related Art

Generally, devices such as automatic vending machines, and the like, are equipped with bank-note processing devices for determining the authenticity of an introduced bank note and accommodating the genuine notes.

A bank-note processing device of this kind generally comprises the four following constituent elements.

(1) A device body comprising casing provided with a bank-note input opening.

(2) Bank note conveyor belt means, provided inside the device body, for conveying input bank notes inside the device body.

(3) Bank note identifying means, provided inside the device body, for determining the authenticity of the bank notes conveyed by the bank-note conveyor belt means.

(4) Bank note accommodating means comprising a stacker for accommodating bank notes regarded as genuine by the bank-note identifying means.

A bank note inserted into the bank-note input opening of the device body is conveyed inside the device body by the bank-note conveyor belt means comprising a conveyor belt driven in rotation by a motor, or the like, and whilst being conveyed in this manner, the authenticity of the bank note is determined by bank-note identifying means comprising bank-note identifying sensors, such as magnetic heads, photosensors, or the like.

If the input bank note is judged by the bank-note identifying means to be a false note, then the conveyor belt of the bank-note conveyor belt means is reversed and the input bank note judged to be false is conveyed back via the bank-note input opening.

If the input bank note is judged by the bank-note identifying means to be a genuine note, then it is conveyed by the bank-note conveyor belt means to the stacker, inside which it is accommodated.

SUMMARY OF THE INVENTION

The present invention is a bank-note processing device comprising, at the least, bank-note conveyor belt means for conveying a bank note inserted via a bank-note input opening, along an substantially U-shaped bank-note conveyance passage, by a conveyor belt; bank-note identifying means for identifying the authenticity of the bank note; and bank-note accommodating means for accommodating bank notes which are regarded by the bank-note identifying means to be genuine notes, provided inside a device body; wherein a unit box comprising at the least the bank-note conveyor belt means and the bank-note identifying means, and excluding the bank-note accommodating means, is installed in an openable and closable manner in the device body, in such a manner that the portion of the conveyor belt facing the bank-note input opening can be exposed.

DESCRIPTION OF THE PREFERRED EMBODIMENTS

Below, embodiment of the bank-note processing device according to the resent invention is described.

Figure 1:
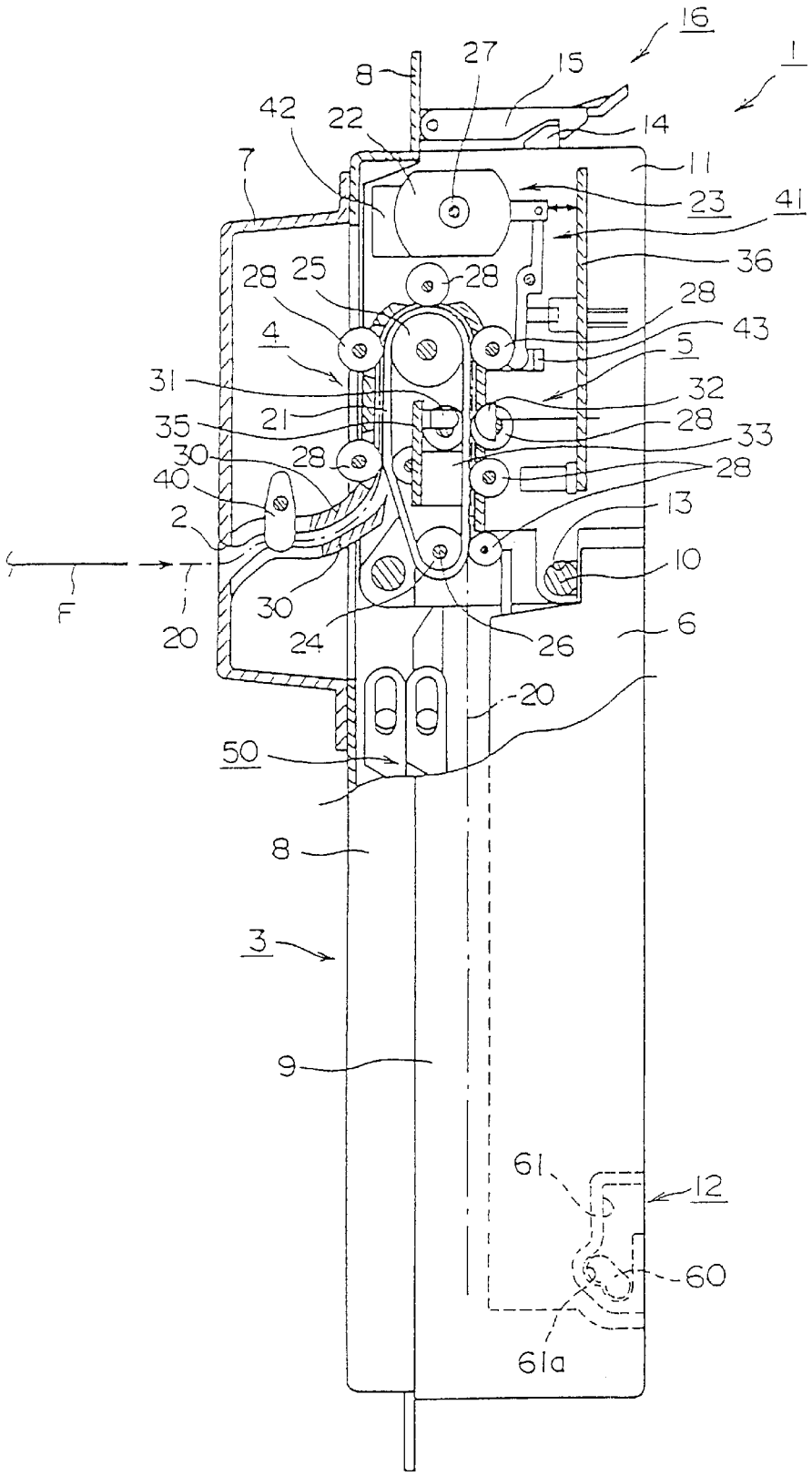
FIG. 1 is a broken-out section showing principal components of a bank-note processing device according to an embodiment of the present invention.

FIG. 1 is a principal sectional view of a bank-note processing device 1 according to an embodiment of the present invention.

Similarly to the conventional device, this bank-note processing device 1 comprises:

(1) A device body 3 comprising a case provided with a bank-note input opening 2;

(2) Bank-note conveyor belt means 4, provided inside this device body 3, for conveying an input bank note inside the device body 3;

(3) Bank-note identifying means 5 for determining the authenticity of a bank note conveyed by the bank-note conveyor belt means 4; and (4) Bank-note accommodating means comprising a stacker 6 for accommodating bank notes regarded by the bank-note identifying means 5 to be genuine notes.

Furthermore, the device body 3 comprises a front mask 7 which is formed with the bank-note input opening 2 and arranged in such a manner that it is exposed via a portion of the door forming the front face of the automatic vending machine (not illustrated); a front plate 8, having the front mask 7 attached to the front face thereof; and a square-shaped casing 9 fixed to this front plate 8.

The bank-note conveyor belt means 4 and bank-note identifying means 5 are disposed inside a unit box 11 supported rotatably about a shaft 10 provided projecting from the inner circumference of the casing 9.

The stacker 6, which is a principal constituent element of bank-note accommodating means for accommodating bank notes which are regarded by the bank-note identifying means 5 to be genuine notes, is supported rotatably and detachably by means of bearing means 12, at the lower portion of the casing 9.

The unit box 11 is supported rotatably with respect to the casing 9, by means of a U-shaped groove 13 formed in the lower end thereof engaging with the shaft 10 projecting from the inner circumference of the casing 9.

The unit box 11 is located and supported with respect to the device body 3, by latching means 16 comprising a projection 14 extending from the upper end of the unit box 11 and a latch lever 15 provided rotatably on a corresponding position of the front plate 8.

In the present application, the projection 14 extending from the upper end of the unit box 11 is called the first engaging means, and the latch lever 15 provided in the device body 3 is called the second engaging means.

Figure 2:
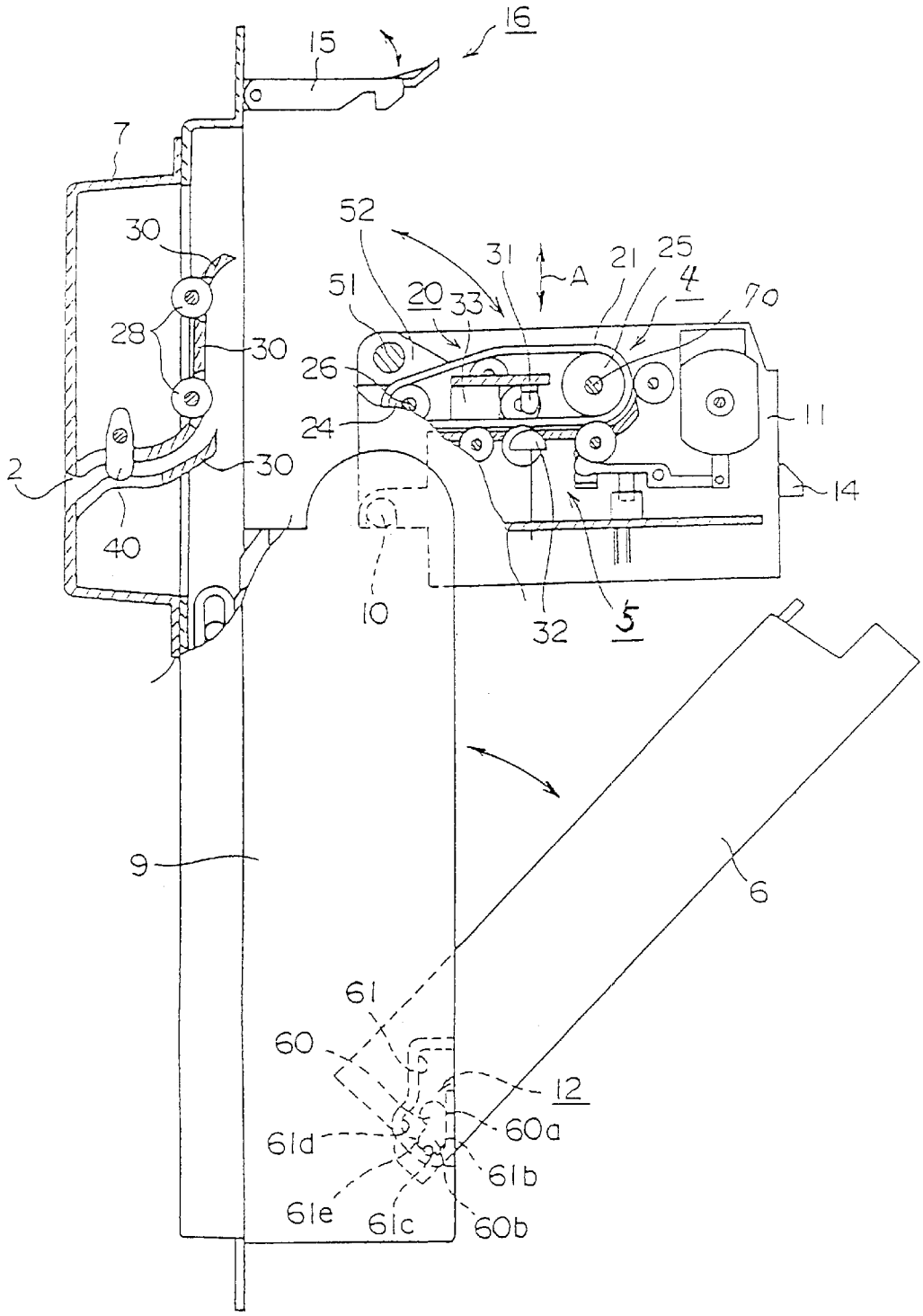
FIG. 2 is a principal part broken-out section illustrating the action of a bank-note processing device according to the embodiment of the present invention.

By means of the structure described above, the attitude of the unit box 11 can be changed, by turning the stacker 6 in a clockwise direction through a prescribed angle of rotation, via the bearing means 12, raising the latch lever 15 of the latching means 16 to release the engagement between the latch lever 15 and the projection 14, and further turning the stacker 6 clockwise through a prescribed angle of rotation about the shaft 10 of the casing 9, as illustrated in FIG. 2.

In other words, as illustrated by the position of the unit box 11 in FIG. 2, the unit box 11 comprising the bank-note conveyor belt means 4 and the bank-note identifying means 5 can be opened up from the device body 3, in such a fashion that the portion of the conveyor belt 21 facing the bank-note input opening 2 is exposed.

Figure 3:
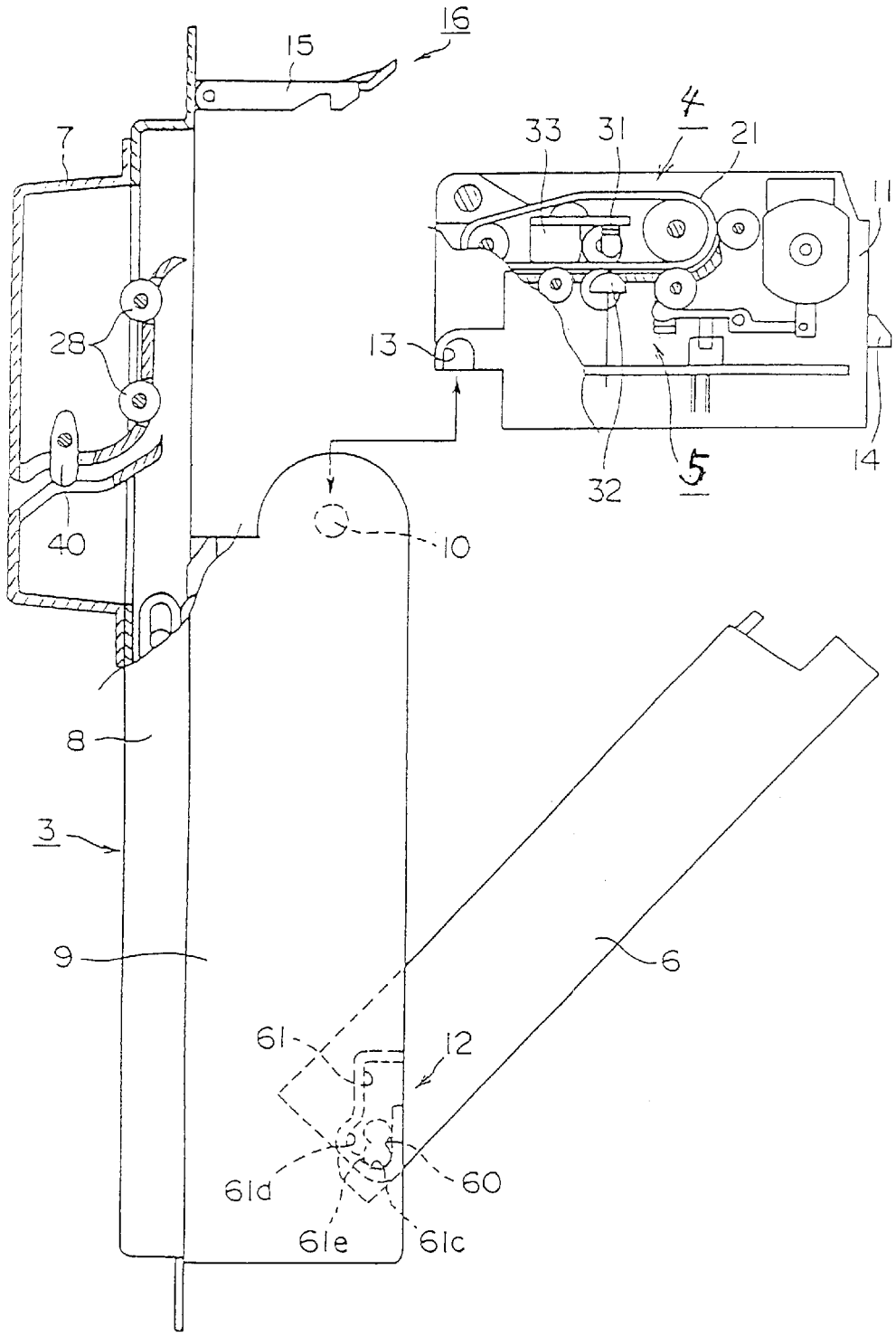
FIG. 3 is a principal part broken-out section showing the action of a bank-note processing device according to the embodiment of the present invention.

Moreover, if the unit box 11 is moved upwards from the position shown in FIG. 2, as illustrated by arrow A, the whole unit box 11 can be removed simply from the casing 9 of the device body 3, as illustrated in FIG. 3.

As shown in FIG. 1, of the bank-note conveyor belt means 4 and the bank-note identifying means S disposed inside the unit box 11 described above, the bank-note conveyor belt means 4 comprises an endless conveyor belt 21 provided extending inside an substantially U-shaped winding portion of a bank-note guide passage 20 formed connecting to the bank-note input opening 2, as depicted by an alternate long and short dash line, and driving means 23 comprising a motor 22 which drives the conveyor belt 21 in rotation.

In the present application, the portion of the bank-note guide passage 20 from the bank-note input opening 2 to the conveyor belt 21 inside the unit box 11 is called the first bank-note guiding means, and the portion of the bank-note guide passage 20 formed in an U-shaped winding fashion inside the unit box 11 is called the second bank-note guiding means.

Figure 9:
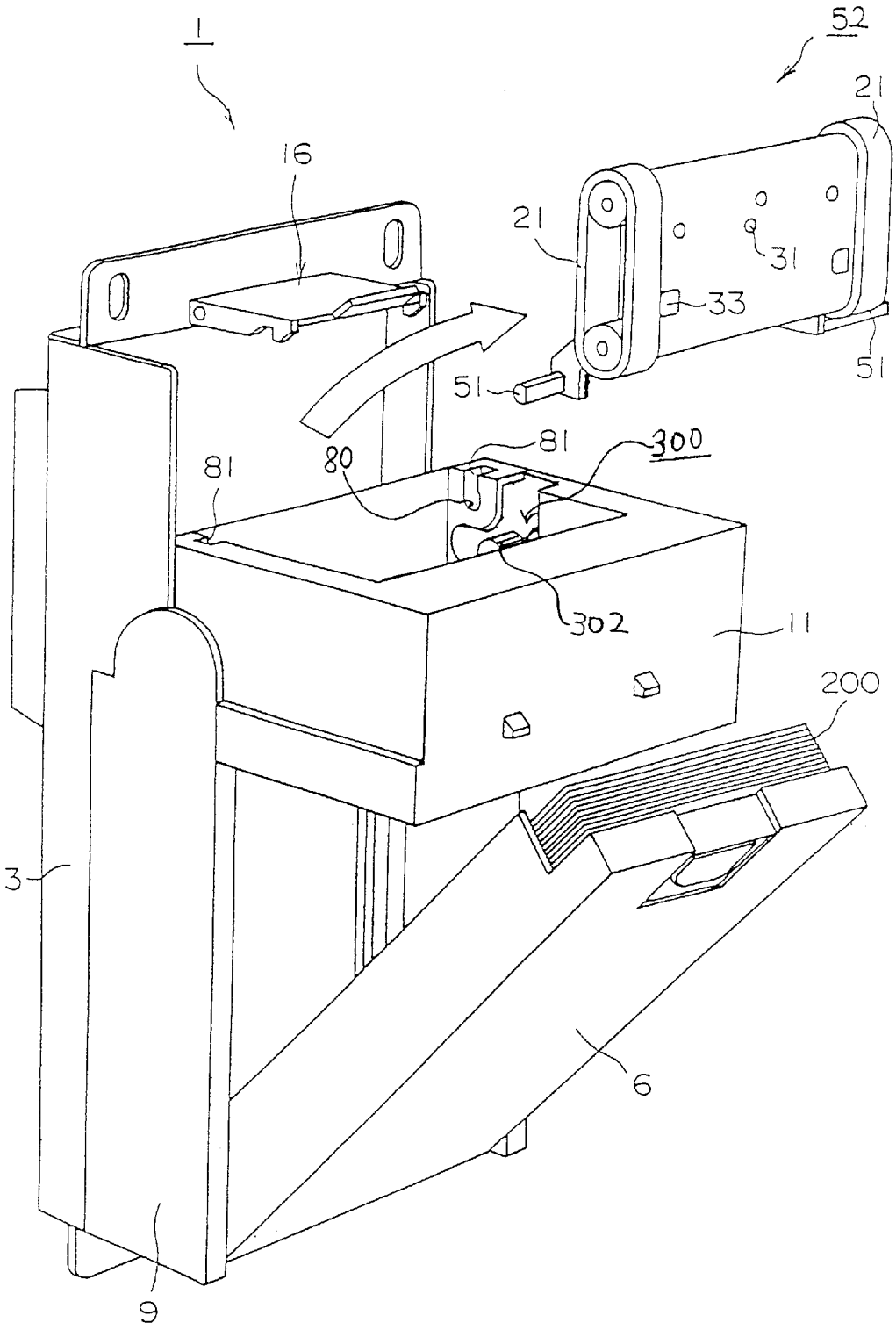
FIG. 9 is a perspective view showing the action of the further embodiment of the present invention.

Of the bank-note conveyor belt means 4, the endless conveyor belt 21 is extended between a drive pulley 24 and an idle pulley 25 provided a prescribed distance apart in the vertical direction, and as illustrated in FIG. 9, inside the unit box 11, geared power transmission means 300 comprising a gear system is provided between a shaft 26 supporting the drive pulley 24 and the drive shaft 27 of the motor 22 forming the driving means 23.

Figure 11:
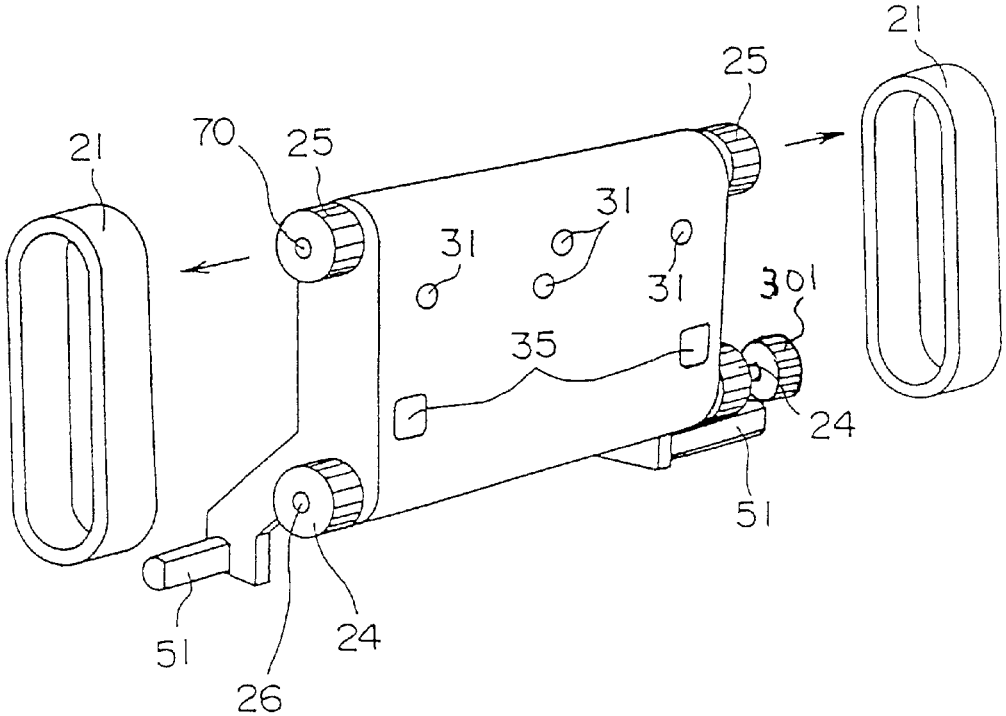
FIG. 11 is a perspective view showing the action of the further embodiment of the present invention.

As illustrated in FIG. 11, a gear wheel 301 forming the final stage of geared power transmission means 300 (FIG. 9) is fixed to the shaft 26 supporting the drive pulley 24, and the gear wheel 301 forming this final stage and a penultimate-stage gear wheel 302 (FIG. 9) of the geared power transmission means 300 (FIG. 9) which engages with the gear wheel 301, are constituted in such a fashion that they are separable.

Consequently, if the drive shaft 27 of the motor 22 shown in FIG. 1 is caused to rotate in a first direction, on the basis of a drive signal from a control device (not illustrated), the shaft 26 supporting the drive pulley 24 is driven in the first direction via the geared power transmission means 300 (FIG. 9) comprising a gear wheel system, and hence the drive pulley 24 is caused to rotate and the conveyor belt 21 is also rotated in the first direction.

A plurality of idle rollers 28 are pressed against the surface of this drive belt 21, and an input bank note is held between these idle rollers 28 and the conveyor belt 21, whereby, when the conveyor belt 21 rotates in the first direction, the input bank note is conveyed in a stable fashion, along the bank-note guide passage 20, in the downstream direction thereof.

In the present application, of the plurality of idle rollers 28, the plurality of idle rollers 28 which are disposed on the casing side 9 of the device body 3 are called the first plurality of idle rollers, and the plurality of idle rollers 28 which are disposed in the unit box 11 are called the second plurality of idle rollers.

Numeral 30 in FIG. 1 denotes a bank-note guide chute formed in line with the bank-note guidance passage 20.

On the other hand, the bank-note identifying means 5 comprises a light-emitting sensor 31 and a light-receiving sensor 32, which are arranged to face each other on the opposite sides of the conveyor belt 21 described above and which are optical sensors for detecting light and shade in particular locations of the input bank note passing by same, a magnetic sensor 33 for detecting magnetic force at particular locations of the input bank note passing by same, and the like.

The light-emitting sensor 31 and the magnetic sensor 32 are mounted on a printed circuit board 35 accommodated inside the unit box 11 and the light-receiving sensor 32 is mounted on a further printed circuit board 36.

Next, the action of the bank-note processing device 1 is explained, along with further description of the composition thereof.

As illustrated in FIG. 1, when a bank note F is inserted into the bank-note input opening 2, the front end thereof is detected by a bank-note detection sensor 40, and on the basis of this detection signal, the control device (not illustrated) switches on the motor 22 of the bank-note conveyor belt means 4, causing same to rotate m the first direction.

When the motor 22 of the bank-note conveyor belt means 4 is caused to rotate in the first direction in this manner, the drive pulley 24 is rotated in a clockwise direction, via the geared power transmission means (not illustrated), the drive belt 21 is caused to rotated in the first direction (in a clockwise fashion), and the input bank note is conveyed towards the stacker 6 along bank-note guide passage 20 indicated by the dotted line.

At the same time, a solenoid 42 of shutter means 41 for opening and closing the bank-note guide passage 20 is switched on, whereby the shutter 43 if is activated and the bank-note guide passage 20 is opened.

Thereupon, the input bank note F inserted via the bank-note input opening 2 is conveyed along the bank-note guide passage 20 towards the stacker 6, and during this conveyance, the authenticity of the input bank note is determined by means of the light-emitting sensor 31, light-receiving sensor 32 and the magnetic sensor 33 in the bank-note identifying means 5.

If the input bank note is judged to be a genuine one, then it is guided to the front face of the stacker 6, which is positioned further downstream in the bank-note guide passage 20, whereupon the input bank note regarded as a genuine note is moved inside the stacker 6 by means of commonly known link-type bank-note moving means 50 forming a constituent element of bank-note accommodating means, and is accommodated therein.

The bank-note accommodating means is constituted by the bank-note moving means 50 and the stacker 6.

On the other hand, if the input bank note F is identified by the bank-note identifying means 5 to be a false note, then the control device (not illustrated) causes the motor 22 of the bank-note conveyor belt means 4 to rotate in the opposite direction to the first direction, whereby the conveyor belt 21 is rotated in the opposite direction, in other words, in the anti-clockwise direction, and the input bank note F is conveyed back out via the bank-note input opening 2. Thereupon, the solenoid 42 of the shutter means 41 for opening and closing the bank-note guide passage 20 is switched off and the shutter 43 is operated, whereby the bank-note guide passage 20 is closed.

Next, the operations performed during maintenance inspection are explained, along with further detailed description of the composition.

In the case of a maintenance inspection in order, for instance, to clean the conveyor belt 21 of the bank-note conveyor belt means 4 or the light-emitting and light-receiving sensors 31, 32 and the magnetic sensor 33 of the bank-note identifying means 5, firstly, as illustrated in FIG. 2, the stacker 6 is positioned by rotating same in a clockwise direction through a prescribed angle of rotation, via the bearing means 12.

Thereupon, the latch lever 15 of the latching means 16 is raised, thereby releasing the engagement between the latch lever 15 and the projection 14, whereupon the unit box 11 is turned through a prescribed angle of rotation in the clockwise direction, about the shaft 10 of the casing 9.

By so doing, the unit box 11 containing, at the least, the bank-note conveyor belt means 4 and the bank-note identifying means 5, is opened up with respect to the device body 3, in such a fashion that the portion of the conveyor belt 21 facing the bank-note input opening 2 is exposed, and hence, in this state, the conveyor belt 21 can be cleaned in a simple manner by using a wire brush, or other such tool.

On the other hand, when the unit box 11 is in the rotational position shown in FIG. 2, the light-emitting and light-receiving sensors 31, 32 and the magnetic sensor 33 in the bank-note identifying means 5 are positioned to the rear of the conveyor belt 21 of the bank-note conveyor belt means 4, and hence they cannot be cleaned directly in the state illustrated in FIG. 2.

The shaft 26 of the drive pulley 24 and the shaft 70 of the drive pulley 25, between which the conveyor belt 21 of the bank-note conveyor belt means 4 is extended, are installed in a unit 52 comprising a support plate which is held rotatably about a shaft 51 with respect to the unit box 11.

Figure 4:
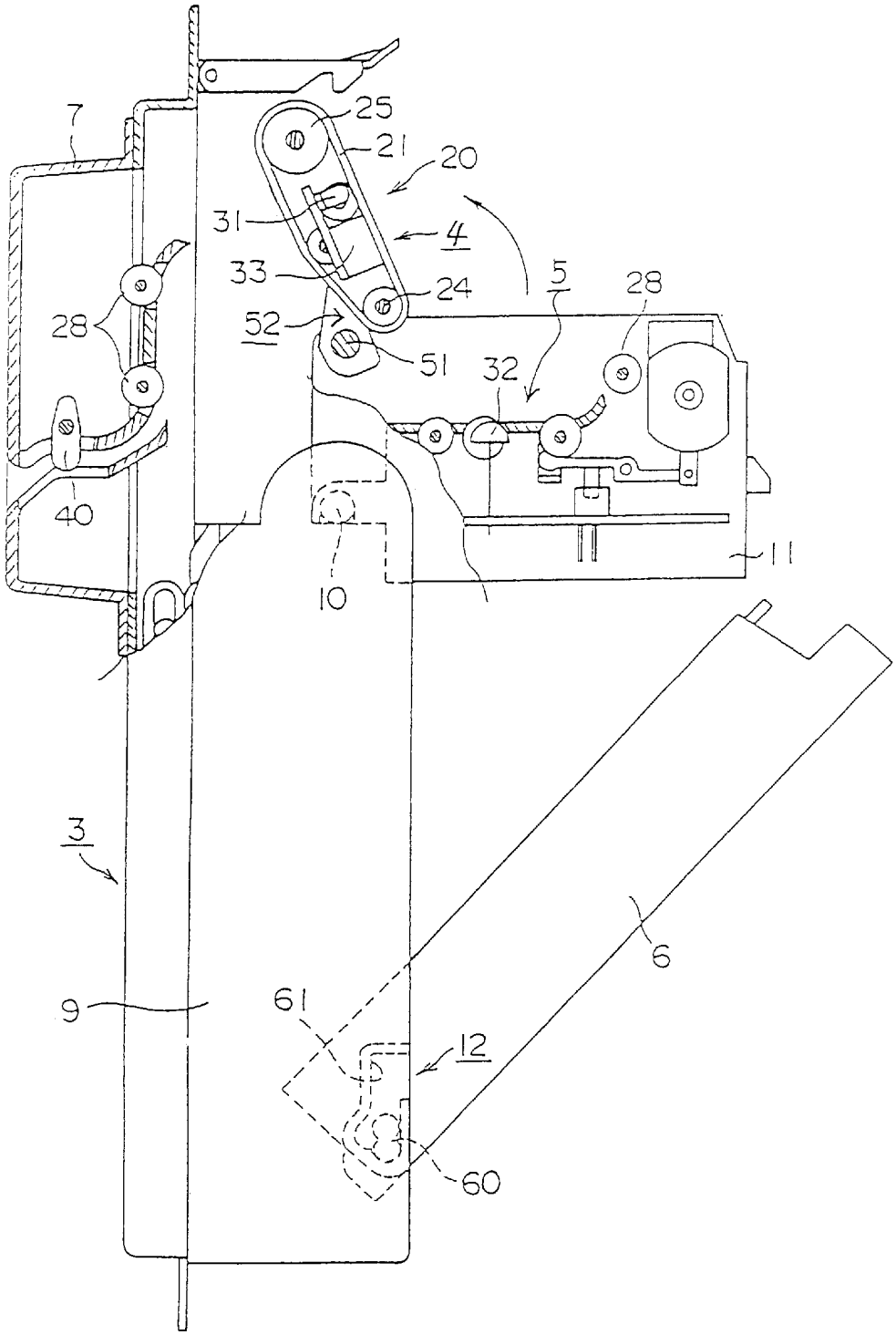
FIG. 4 is a principal part broken-out section showing the action of a bank-note processing device according to the embodiment of the present invention.

Therefore, when the unit 52 is rotated from the position shown in FIG. 2 in an anti-clockwise direction about the shaft 51, the rear side of the conveyor belt 21 becomes exposed, as illustrated in FIG. 4, in conjunction with which, the light-emitting and light-receiving sensors 31, 32 and the magnetic sensor 33 in the bank-note identifying means 5 located to the rear of the conveyor belt 21 also become exposed, thereby making it possible for the light-emitting and light-receiving sensors 31, 32 and the magnetic sensor 33 in the bank-note identifying means 5 to be cleaned in a simple manner by using a wire brush, or other such tool, in the state shown in FIG. 4.

The above-described actions and effects of the present invention have the following significance.

Namely, since the bank-note processing device handles bank notes which are being publicly used, bank notes inserted into the device generally have dust, dirt or the like, adhering thereto. Such dirt is likely to be attached to the conveyor belt of the bank-note conveyor belt means and the magnetic head and photosensors of the bank-note identifying means, and other components of the device, thereby leading to the risk of bank-note conveyance errors or bank-note identifying errors. In order to prevent such errors, it is necessary to perform maintenance and inspection tasks on the bank-note processing device, such as periodic cleaning or replacement of the conveyor belt in the bank-note conveyor belt means or the magnetic head and photosensors in the bank-note identifying means.

However, in conventional bank-note processing devices, the bank-note conveyor belt means and the bank-note identifying means are installed in an non-detachable fashion inside the device body, thereby making cleaning thereof very difficult, and in some cases, it is necessary to perform such cleaning tasks by disassembling the whole device, thereby involving a very complicated operation.

According to the bank-note processing device 1 of the present invention, if the unit box 11 is turned through a prescribed angle of rotation in the clockwise direction about the shaft 10 of the casing 9, and the unit 52 is then turned in an anti-clockwise direction about the shaft 51, with respect to the unit box 11, the conveyor belt 21 in the bank-note conveyor belt means 4, the light-emitting and light-receiving sensors 31, 32 and the magnetic sensor 33 in the bank-note identifying means 5 are readily exposed. As a result, maintenance and inspection tasks for same can be performed in a very simple manner.

In the aforementioned embodiment, a case was described where cleaning of the bank-note conveyor belt means 4 and the bank-note identifying means 5 is carried out, whilst the unit box 11 is in a state where it has been turned clockwise through a prescribed angle of rotation about the shaft 10 of the casing 9, as illustrated in FIG. 4, but this cleaning task can also be performed once the whole unit box 11 has been removed from the casing 9, as illustrated in FIG. 3.

On the other hand, in the aforementioned bank-note processing device 1, the bearing means 12 which supports the stacker 6 rotatably on the casing 9 of the device body 3 projects on either side of the stacker 6, as illustrated in FIG. 1, and comprises a projection 60 having an substantially binocular-shaped cross-section formed by a pair of superimposed arcs, and a guide groove 61 having a side wall section 61*a* similarly having an substantially binocular-shaped cross-section formed by a pair of superimposed arcs.

By adopting bearing means 12 of this kind, when the stacker 6 is turned in a clockwise direction about the projection 60, as illustrated in FIG. 2, the flat portion 60*a* of the projection 60 and the vertical wall 61*b* of the guide groove 61 confront each other, thereby making it possible to locate the stacker 6 in a prescribed rotational position.

At this rotational position of the stacker 6, the open upper end of the stacker 6 is exposed, and hence the bank notes accommodated inside the stacker 6 can be removed simply via this upper end.

Figure 5:
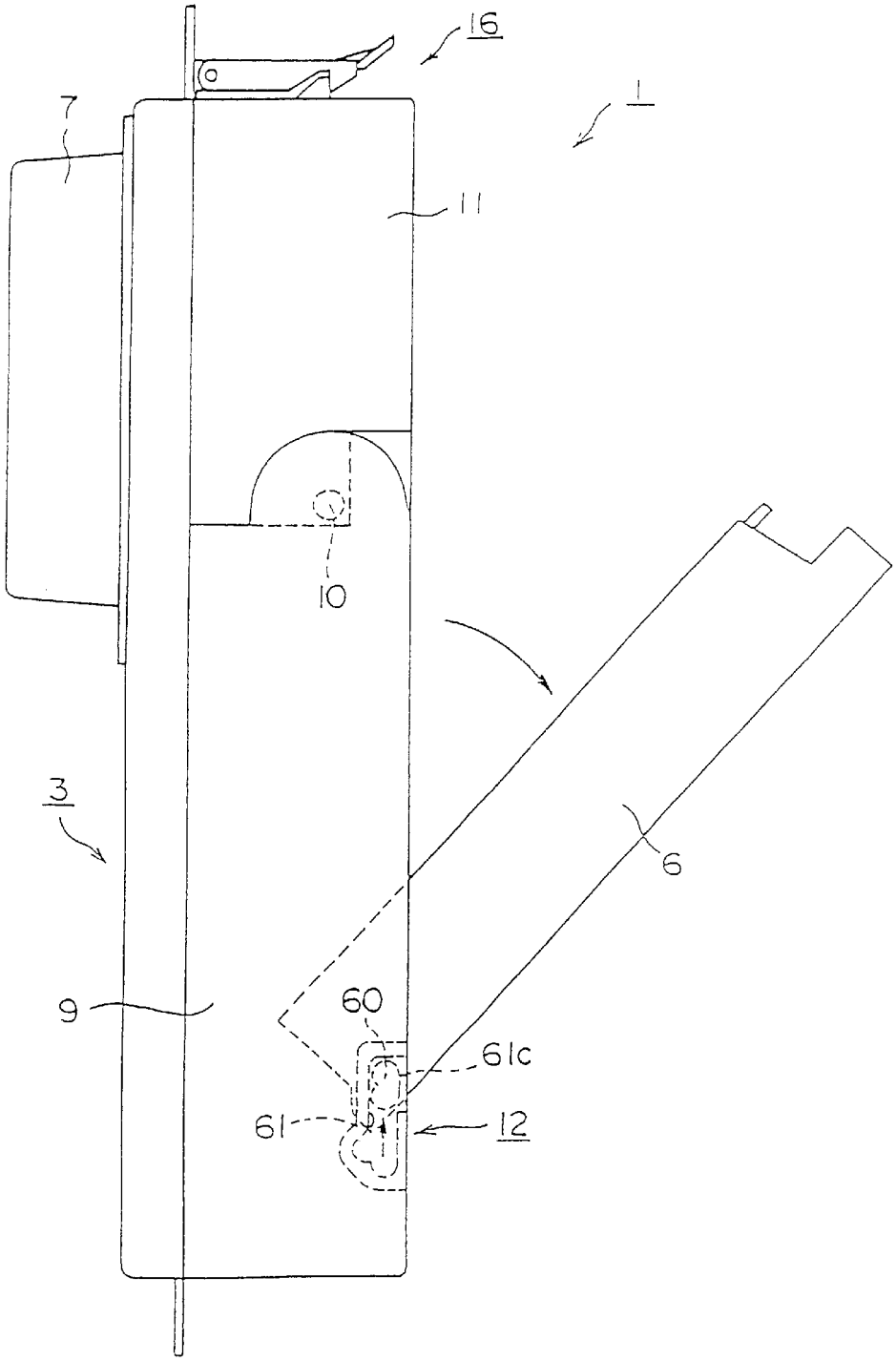
FIG. 5 is a principal part broken-out section of a bank-note processing device showing the action of bearing means according to the embodiment of the present invention.

On the other hand, in order to remove the stacker 6 from the casing 9, the stacker 6 is moved vertically upwards, as shown in FIG. 5, from the position of the stacker 6 illustrated in FIG. 2.

Figure 6:
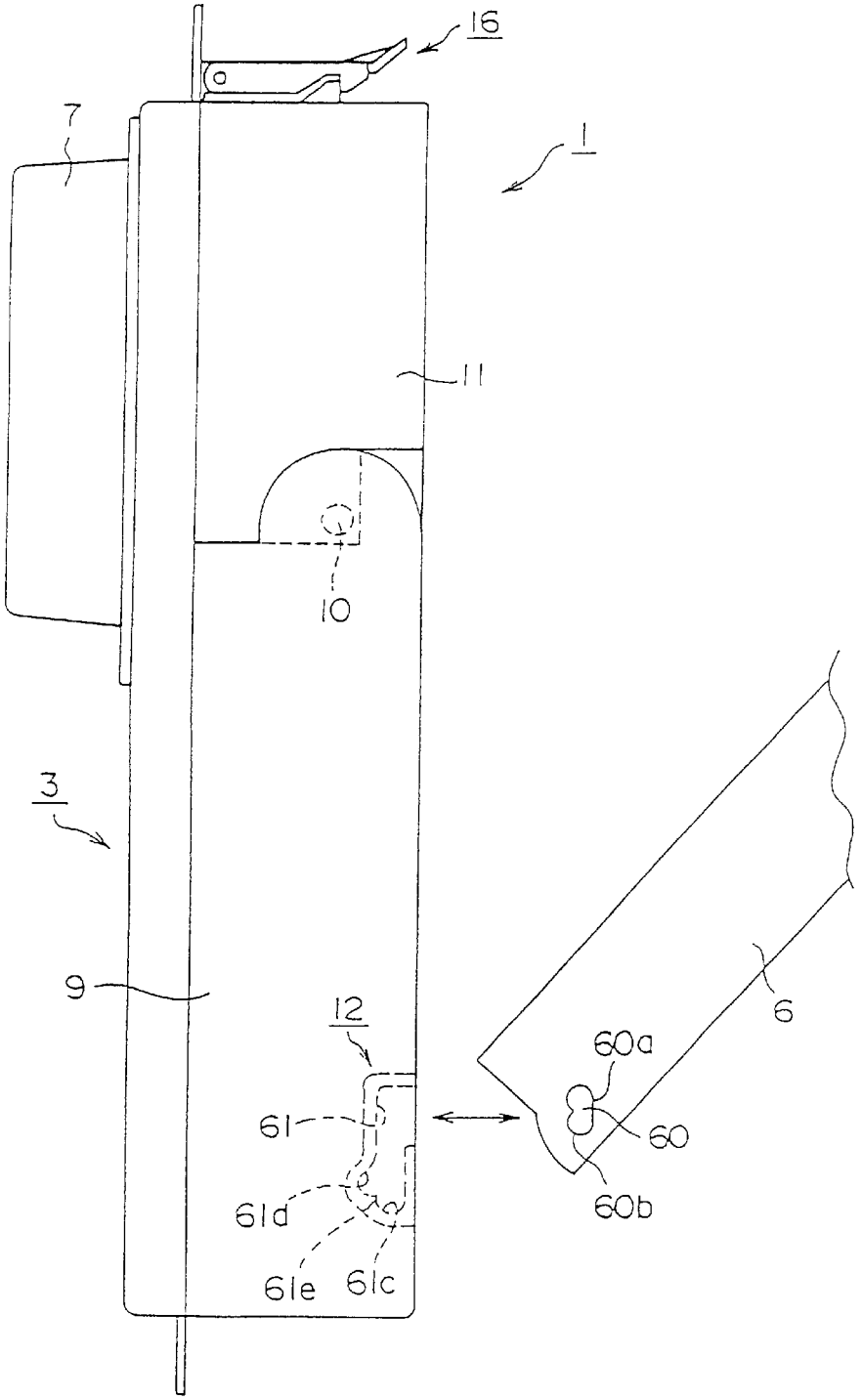
FIG. 6 is a principal part broken-out section of a bank-note processing device showing the action of bearing means according to the embodiment of the present invention.

By so doing, the projection 60 of the stacker 6 is moved upwards along the guide groove 61 and reaches the open end 61*c* of the guide groove 61, whereby, if the stacker 6 is then moved horizontally to the right, as shown in FIG. 6, from the position of the stacker 6 illustrated in FIG. 5, the engagement between the projection 60 on the stacker 6 and the guide groove 61 is released, and hence the stacker 6 becomes detached from the casing 9.

By adopting the bearing means 12, when the stacker 6 is fixed in a position where it is inclined to a prescribed angle of rotation as shown in FIG. 2, the arc section 60*b* of the projection 60 engages with another arc section 61*c* of the side wall section 61*a* having an substantially binocular-shaped cross-section, as formed in the guide groove 61. Consequently, even if the stacker 6 is mistakenly turned further in the clockwise direction, from the position shown in FIG. 2, the arc section 60*b* of the projection 60 will not ride up over the peak section 61*e* formed between the arc section 61*c* and the other arc section 61*d* in the guide section 61, and hence it is possible to eliminate, as far as possible, any risk of the stacker 6 becoming detached accidentally from the guide groove 61 and causing the bank notes accommodated inside the stacker 6 to be scattered about.

In the aforementioned embodiment, as shown in FIG. 3, at least the bank-note identifying means 5 and the bank-note conveyor belt means 4 are disposed inside the unit box 11 and this unit box 11 itself is devised in such a manner that it is installed detachably on the casing 9 of the device body 3, whereby if, for example, a further unit box 11 of the same shape and equipped with bank-note identifying means 5, wherein the installation positions of the light-emitting and light-receiving sensors 31, 32 and the magnetic sensor 33, etc. are different to those in the embodiment, is previously prepared as an alternative and is installed inside the casing 9 in place of the unit box 11 according to the embodiment, then it is possible to change rapidly the positions of the light sensors and magnetic sensors when counterfeit notes are inserted into the device, or other mischievous actions take place.

Moreover, by previously preparing a variety of unit boxes 11 having different installation positions for the bank-note identifying means 5 or different installation positions for the bank-note conveyor belt means 4, with respect to bank notes of different countries of the world which are of mutually different sizes, then it is possible readily to provide a bank-note processing device which can be adapted swiftly to bank notes of any country which are of different sizes, simply by replacing the unit box 11 with one which corresponds to the bank notes of the respective country, without having to implement major design changes of the whole bank-note processing device 1.

Furthermore, in the aforementioned embodiment, as shown in FIG. 4, the bank-note identification sensors such as light-emitting sensor 31 and magnetic sensor 33, which form part of the bank-note identifying means 5, and the conveyor belt 21, which forms a part of the bank-note conveyor belt means 4, etc., are disposed in unit 52, and this unit 52 is simply supported rotatably with respect to the unit box 11, by means of the shaft 51. However, the present invention is not limited to the aforementioned embodiment. For example, as illustrated in FIG. 7 where portions which are the same as in FIG. 2 are similarly labelled, the shaft 51 of the unit 52 may be formed with an substantially D-shaped cross-section, and furthermore, this shaft 51 may be made directional and may be installed detachably on the unit box 11, and a bearing is formed in the unit box 11 by which the shaft 51 can be supported rotatably after installation.

Figure 7:
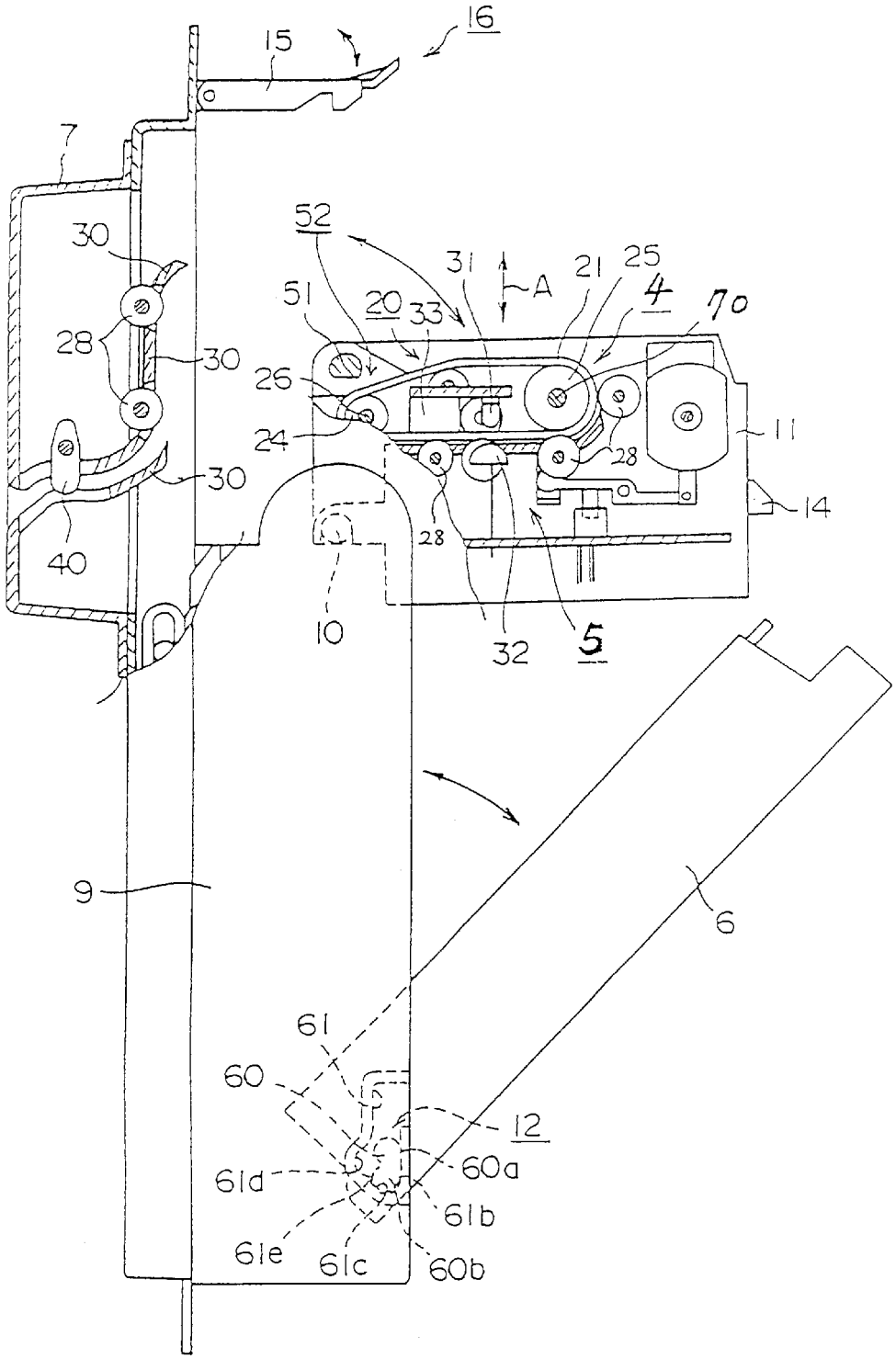
FIG. 7 is a principal part broken-out section of a modification of a bank-note processing device according to the embodiment of the present invention.

By adopting this composition, each portion of the bank-note conveyor belt means 4 and bank-note identifying means 5 mounted in the unit 52 (namely, the conveyor belt 21, drive and idle pulleys 24, 25, light-emitting sensor 31, magnetic sensor 33, and the like) can be installed in a detachable fashion with respect to each of the portions of the bank-note conveyor belt means 4 and bank-note identifying means 5 that are disposed inside the unit box 11 (namely, the second plurality of idle rollers comprising the plurality of idle rollers 28, the light-receiving sensor 32, and the like,) as illustrated in FIG. 7.

Figure 8:
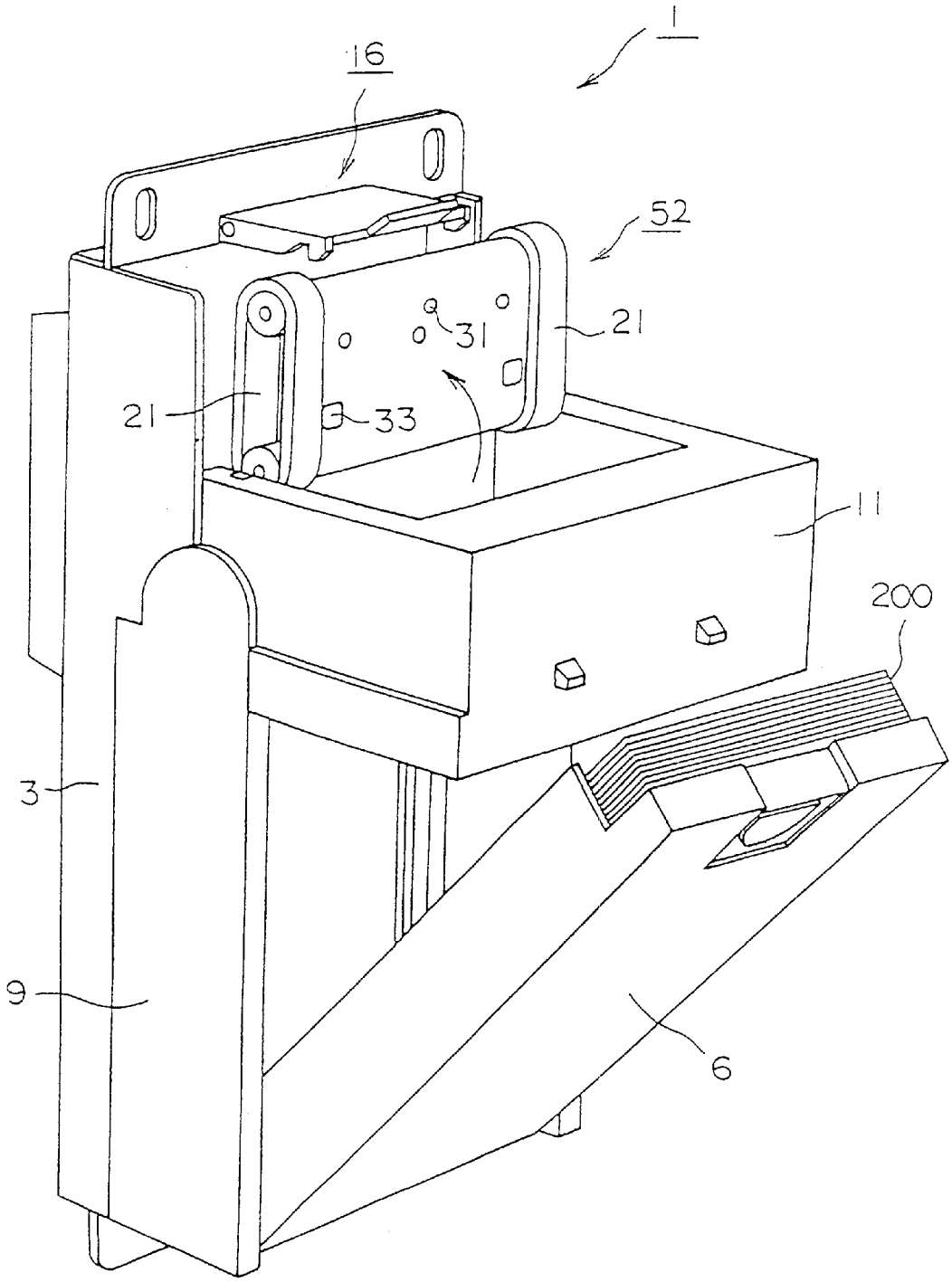
FIG. 8 is a perspective view showing the action of a further embodiment of the present invention.

With the unit 52 being installed detachably with respect to the unit box 11 as described above, if the unit 52 is turned in an anti-clockwise direction about the shaft 51 from the position of the unit 52 shown in FIG. 7, then the unit 52 will rotate and rise up with respect to the unit box 11, as illustrated by the perspective view in FIG. 8 which shows a further embodiment of a bank-note processing device 1.

In this state, if the shaft 51 of the unit 52 is detached from the notches 81 connecting to bearing holes 80 formed on the inner circumference of the unit box 11, as indicated by the arrow in FIG. 9, then the unit 52 itself can be removed from the unit box 11.

In FIG. 8 and FIG. 9, numeral 200 denotes bank notes accommodated inside the stacker 6.

Figure 10:
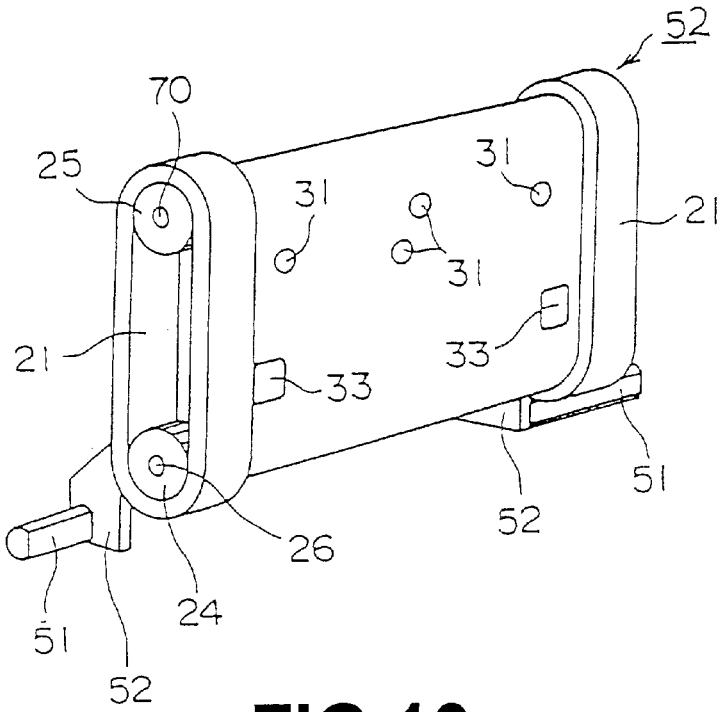
FIG. 10 is a perspective view showing the action of the further embodiment of the present invention.

In this way, by detaching the unit 52 holding a portion of the bank-note identification sensors, such as the light-emitting sensor 31, magnetic sensor 33, and the like, and a portion of the bank-note conveyor belt means 4, such as the conveyor belt 21, from the unit box 11, the whole of the conveyor belt 21 mounted in the unit 52 and extended between the drive pulley 24 and the idle pulley 25 is exposed, as illustrated by FIG. 10 which shows a perspective view thereof, whilst also exposing the various bank-note identification sensors, such as the light-emitting sensor 31, magnetic sensor 33, and the like, forming part of the bank-note identifying means 5.

Consequently, when the unit 52 is in a detached state as depicted in FIG. 10, it is possible readily to clean the various bank-note identification sensors, such as the light-emitting sensor 31, magnetic sensor 33, and the like, mounted in the unit 52 and forming a portion of the bank-note identifying means 5, and moreover, when replacing the conveyor belt 21 forming a portion of the bank-note conveyor belt means 4 mounted in the unit 52, the task of detaching and installing the conveyor belt 21 can be performed in a straightforward manner, simply by moving the conveyor belt 21 in the thrust direction of the drive pulley 24 and the idle pulley 25, as illustrated in FIG. 11.

Figure 12:
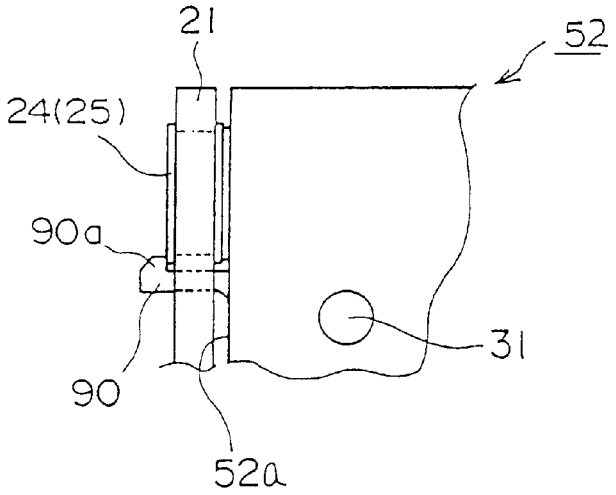
FIG. 12 is a principal part broken-out section of FIG. 10.

When detaching the conveyor belt 21, if the drive pulley 24 and the idle pulley 25 about which the conveyor belt 21 is wound are moved respectively in the thrust directions thereof, there is a risk that they may become detached from the bearings 26, 70 supporting same, and therefore, in order to prevent such detachment of the drive pulley 24 and the idle pulley 25, pulley movement prevention hooks 90 for restricting thrust-direction movement of the drive and idle pulleys 24, 25 are provided on the unit plate 52*a* in respective positions adjacent to the drive pulley 24 and idle pulley 25, as shown in FIG. 12 which is a broken-out section of FIG. 10.

Figure 13:
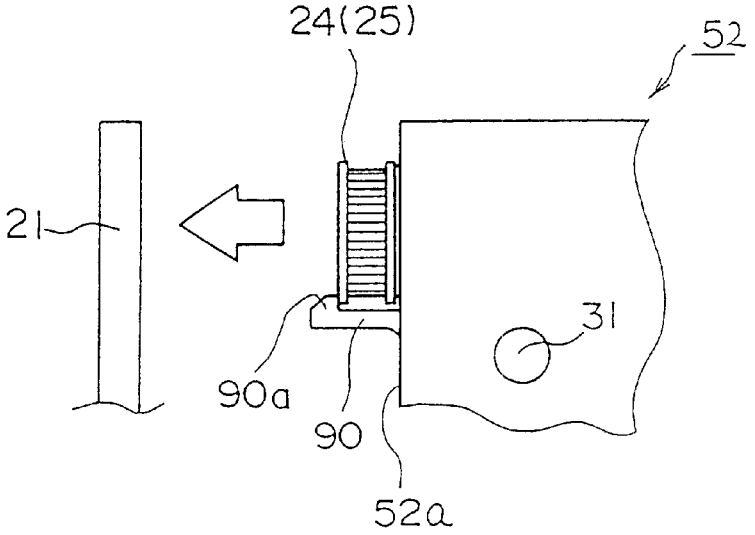
FIG. 13 is a principal part broken-out section of FIG. 10.

By providing pulley movement prevention hooks 90 on the unit plate 52*a* in respective positions adjacent to the drive pulley 24 and the idle pulley 25 in this way, as shown in FIG. 13, the front end sections 90*a* of the pulley movement prevention hooks 90 make contact with the outer edges of the drive pulley 24 and idle pulley 25 if same move in the thrust direction, thereby preventing same from escaping, and consequently, in a maintenance and inspection operation for replacing the conveyor belt 21, the task of replacing the conveyor belt 21 can be performed in a simple manner, whilst preventing detachment of the pulleys 24, 25.

Figure 14:
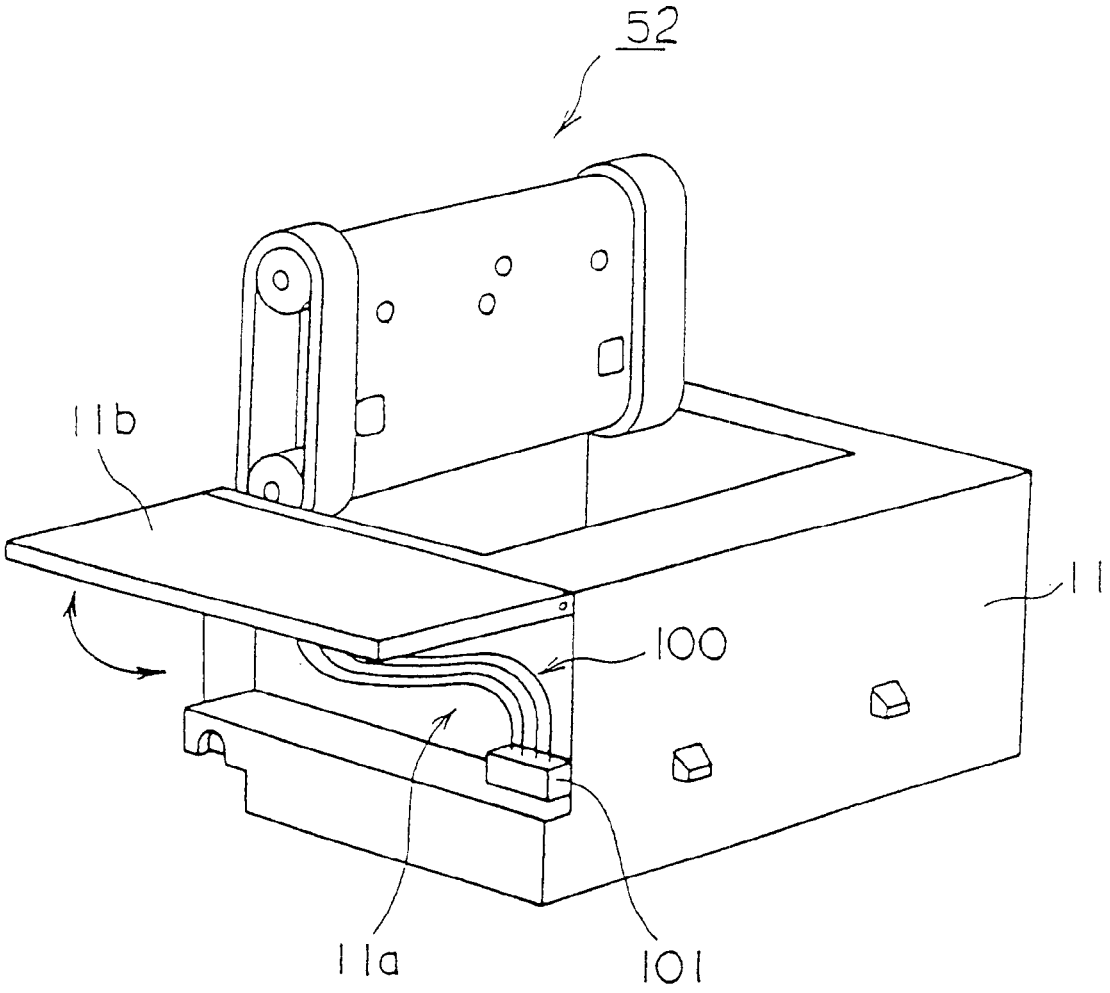
FIG. 14 is a schematic perspective view of a unit box according to the embodiment of the present invention.

Since a printed circuit board 35 on which the bank-note identification sensors, such as the light-emitting sensor 31 and the magnetic sensor 33, are mounted is disposed inside the unit 52, as illustrated in FIG. 1, and since a printed circuit board 36 for sending and receiving signals to and from this printed circuit board 35 is provided inside the unit box 11, there are actually a plurality of cables connecting the unit 52 to the printed circuit board 35, but these cables 100 are accommodated inside a cable housing recess 1 la formed in a side of the unit box 11, as illustrated in FIG. 14 showing a perspective view of the unit box 11, and they are connected to the printed circuit board 36 (FIG. 1) provided in the unit box 11 by means of a connector 101 provided inside this cable housing recess 11*a*.

The cable housing recess 11*a* is covered by an openable and closable lid 11*b*, which is constituted in such a manner that, when the lid 11*b* is closed over the cable housing recess 11*a*, it is fixed to the side of the unit box 11 by latching means (not illustrated).

Therefore, if a cable housing recess 11*a* of this kind is provided, then when performing a maintenance inspection operation, such as removing the unit box 11 from the device body 3, the inconvenience of having the cables 100 catching on the surrounding objects is eliminated, and hence the aforementioned operation can be performed with better efficiency.

As described above, in the bank-note processing device according to the present invention, since the unit box containing at least bank-note conveyor belt means and bank-note identifying means is installed in the device body in an openable and closable fashion, whereby the portion of the conveyor belt facing the bank-note input opening can be exposed, the task of cleaning the bank-note conveyor belt means and the bank-note identifying means can be performed in a very simple manner.

Furthermore, the aforementioned bank-note conveyor belt means and bank-note identifying means are housed inside a unit box which is separate to the device body, this unit box itself being installed detachably in the device body. Therefore, by previously preparing a variety of unit boxes as alternative unit boxes, which have different installation positions for the bank-note identifying means or the conveyor belt means, or other components, it is possible to provide, readily and inexpensively, a bank-note processing device which is compatible with various countries having different bank note sizes, without having to carry out major design changes. In addition, the installation positions for the bank-note identifying means can be changed readily and swiftly in response to the insertion of counterfeit bank notes, thereby making it possible to minimize the loss caused by such mischievous action.

This invention can be implemented in a variety of modes, provided that these do not deviate from the spirit or principal characteristic features of the invention, in respect of which, the foregoing embodiment serves simply as an example in many aspects, and should not be interpreted in a limiting sense. The scope of the invention is that expressed in the claims, and is not restricted in any way to the description contained in the specification. Moreover, s modifications and alterations coming within a scope of equivalence to the present claims are all covered by the present invention.

What is claimed is:

1. A bank-note processing device comprising:

a device body;

bank-note conveyor belt means provided inside the device body and including a conveyer belt, for conveying a bank-note inserted from a bank-note input opening along a substantially U-shaped bank-note conveyance passage by the conveyor belt;

bank-note identifying means provided inside the device body, for determining authenticity of the inserted bank-note;

bank-note accommodating means provided inside the device body, for accommodating only bank-notes regarded by the bank-note identifying means to be genuine bank-notes; and a unit box containing the bank-note conveyor belt means and the bank-note identifying means, and excluding the bank-note accommodating means, the unit box being rotatably supported with the respect to the device body by a shaft that is disposed in the device body at a position opposite to the bank-note input opening, so that the conveyor belt facing side of the bank-note input opening is exposed on a side opposite to a side where the bank-note accommodating means is provided when the unit box is rotated in one direction about the shaft.

2. The bank-note processing device according to claim 1, wherein the unit box is provided detachably with respect to the device body.

3. The bank-note processing device according to claim 1, wherein the bank-note identifying means comprises a plurality of light sensors each comprising a light-emitting section and a light-receiving section.

4. The bank-note processing device according to claim 1, wherein the bank-note identifying means comprises a plurality of light sensors each comprising a light-emitting section and a light-receiving section, and at least one magnetic sensor.

5. The bank-note processing device according to claim 1, wherein a portion of the bank-note conveyor belt means and a portion of the bank-note identifying means constitute a unit, the unit being provided in an openable and closable fashion with respect to the unit box.

6. The bank-note processing device according to claim 5, wherein the unit is provided detachably in the unit box.

7. The bank-note processing device according to claim 5, wherein the portion of the bank-note identifying means comprises either the light-emitting sections or the light-receiving sections of the plurality of light sensors.

8. The bank-note processing device according to claim 5, wherein the portion of the bank-note identifying means comprises either the light-emitting sections or the light-receiving sections of the plurality of light sensors, and at least one magnetic sensor.

9. A bank-note processing device comprising:

bank-note conveyor belt means including a conveyor belt, for conveying a bank-note inserted from a bank-note input opening;

bank-note identifying means for determining authenticity of the bank-note;

first bank-note guiding means comprising the bank-note input opening and a portion of a bank-note conveyance passage connected to the bank-note input opening;

a device body containing a first plurality of idle rollers which lie in contact with the conveyor belt of the bank-note conveyor belt means and form the bank-note conveyance passage in cooperation with the first bank-note guiding means; and a unit box provided in the device body by way of a shaft that is disposed in the device body at a position opposite to the bank-note input opening in a rotatable fashion, the unit box containing:

the bank-note conveyor belt means;

a second plurality of idle rollers which lie in contact with the conveyor belt and form the bank-note conveyance passage;

driving means for driving the bank-note conveyor belt means; and the bank-note identifying means for determining the authenticity of the bank-note, wherein, when the unit box is rotated in one direction about the shaft, the conveyor belt facing a side of the bank-note input opening is exposed on a side opposite to a side where a bank-note accommodating means is provided.

10. The bank-note processing device according to claim 9, wherein the bank-note identifying means comprises a plurality of light sensors each comprising a light-emitting section and a light-receiving section.

11. The bank-note processing device according to claim 9, wherein the bank-note identifying means comprises a plurality of light sensors each comprising a light-emitting section and a light-receiving section, and at least one magnetic sensor.

12. The bank-note processing device according to claim 9, wherein a portion of the bank-note conveyor belt means and a portion of the bank-note identifying means constitute a unit, the unit being provided in an openable and closable fashion with respect to the unit box.

13. The bank-note processing device according to claim 12, wherein the unit is provided detachably in the unit box.

14. The bank-note processing device according to claim 12, wherein the conveyor belt is provided detachably in a state where the unit is opened out from the unit box.

15. The bank-note processing device according to claim 12, wherein the portion of the bank-note identifying means comprises either the light-emitting sections or the light-receiving sections of the plurality of light sensors.

16. The bank-note processing device according to claim 12, wherein the portion of the bank-note identifying means comprises either the light-emitting sections or the light-receiving sections of the plurality of light sensors, and a magnetic sensor.

17. The bank-note processing device according to claim 9, wherein the unit box is provided with a housing section in one side thereof, the housing section being covered by an openable and closable lid and provided with a connector section for a cable extending from the device body.

18. The bank-note processing device according to claim 9, wherein the unit box is provided with first engaging means on one end thereof and a U-shaped groove on another end thereof, and the device body is provided with second engaging means to be coupled with the first engaging means and a shaft to be fitted into the U-shaped groove, whereby the unit box is provided in an openable and closable fashion and detachable fashion, with respect to the device body.

19. The bank-note processing device according to claim 9, wherein the driving means comprises a motor and geared power transmission means for transmitting drive power of the motor, and the bank-note conveyor belt means comprises the conveyor belt extended between pulley means comprising a drive pulley and an idle pulley.

20. The bank-note processing device according to claim 19, further comprising a pulley movement restricting hook for preventing movement of the pulleys in a thrust direction of the pulleys, the hook being provided in a position adjacent to the pulley means.

* * * * *